US011260680B2

(12) United States Patent
Yosefi et al.

(10) Patent No.: US 11,260,680 B2
(45) Date of Patent: Mar. 1, 2022

(54) INTEGRATED PRINTING AND PACKAGING SOLUTION

(71) Applicant: Matan Digital Printing LTD., Rosh Haayin (IL)

(72) Inventors: Hanan Yosefi, Ganei Tikva (IL); Dani Barel, Herzliya (IL); Dan Kalati, Herzliya (IL); Roman Gorodetzky, Etz Ephraim (IL)

( * ) Notice: Subject to any disclaimer, the term of this patent is extended or adjusted under 35 U.S.C. 154(b) by 0 days.

(21) Appl. No.: 16/732,582

(22) Filed: Jan. 2, 2020

(65) Prior Publication Data

US 2021/0206181 A1 Jul. 8, 2021

(51) Int. Cl.

| | |
|---|---|
| ***B41J 11/66*** | (2006.01) |
| ***B41J 11/70*** | (2006.01) |
| ***B41J 13/00*** | (2006.01) |
| ***B41J 11/48*** | (2006.01) |
| *B41J 13/02* | (2006.01) |
| *B41J 3/407* | (2006.01) |

(52) U.S. Cl.

CPC ..... *B41J 11/66* (2013.01); *B41J 11/48* (2013.01); *B41J 11/666* (2013.01); *B41J 11/70* (2013.01); *B41J 11/703* (2013.01); *B41J 13/0054* (2013.01); *B41J 3/4075* (2013.01); *B41J 13/0045* (2013.01); *B41J 13/02* (2013.01)

(58) Field of Classification Search

CPC . B41J 11/66; B41J 11/666; B41J 11/70; B41J 11/703; B41J 11/48; B41J 13/0054; B41J 13/02; B41J 13/0045; B41J 3/4075

See application file for complete search history.

(56) References Cited

U.S. PATENT DOCUMENTS 7,127,951 B2 * 10/2006 Sartain ..... G01N 3/08 73/818

* cited by examiner

*Primary Examiner* — Geoffrey S Mruk
(74) *Attorney, Agent, or Firm* — Robert G. Lev

(57) ABSTRACT

A printing system for printing images onto a medium supplied as feed-stock, said system comprising a printer, a control computer and data inputting means, a printer head, a cutter, at least one rewinder and a taper; the print head for printing individual work-pieces onto the medium; the cutter for cutting the medium into individual work-pieces, and the at least one rewinder for rewinding the work-pieces into coreless-rolls, and the taper comprising a tape dispenser and printer for printing identifying data onto a piece of tape applied to fasten each coreless roll closed wherein the cutter and the printing of the tape is controlled by the control computer, wherein the cutter is configured to section the work-piece from the feedstock after it has started to be fed into the rewinder.

17 Claims, 3 Drawing Sheets

INTEGRATED PRINTING AND PACKAGING SOLUTION

BACKGROUND OF THE INVENTION

Wide format digital printers are increasingly used to print wallpaper, reproduction paintings, posters, signs and the like.

The media to be printed may be supplied as roll stock or flat sheets.

After printing flexible media and cutting to size, the media may be rolled up into a spindle-less roll that may be wrapped with film, inserted into a postal tube, secured with tape or a rubber band and rolling machines are known.

Typically, one machine prints the media and the printed media is rolled up onto a take up spool which is then unrolled, sectioned and rolled in a separate machine or by hand.

Alternatively, the media may be printed and sectioned and then stacked for subsequent feeding into a second rolling machine.

However, machines that print and roll media are also known. These take up less room than two separate machines and use less labor.

An example of this is the Fotoba™ XLD170+REW160 solution, consisting of a digital printer (XLD170) that feeds straight into a rolling machine (REW160) located downstream of the printer. After the printed medium is fed into the rolling machine, it is sectioned from the feed roll, and then rolling up continues and the coreless roll of printed medium, such as a poster, is then released from the rolling machine, and may, for example, be inserted into a cardboard tube for dispatch to the customer. See https://www.fotoba.com/special-applications/cutting-and-rolling-posters-in-one-step/ where such a printer and rewinder combination is shown.

There is, however, a disadvantage in printing, sectioning and rolling up the printed media, in that misprinted media is rolled up and cannot be examined without unrolling. Also, where a digital printer is configured to print a number of different images, such as posters, for example, if the posters are rolled up, it is difficult to identify the specific poster once it has been rolled up.

There is a need for a single machine that can print posters, sections (tiles) of a bigger sign and the like, possibly due to automatic inspection in the system to ensure that the right files were printed and the print result is acceptable, to roll up the work-pieces and to mark them with identifying details, such as a batch number, serial number or description, so that that contents can be identified without unrolling, and the present invention is directed to such a machine.

SUMMARY OF THE INVENTION

A first aspect of the invention is directed to a printing system for printing images onto a medium supplied as feed-stock, said machine comprising a control computer and data inputting means, a printer head, a cutter, at least one rewinder and a taper; the print head for printing individual work-pieces onto the medium, the cutter for cutting the medium into individual work-pieces, and the rewinding station for rewinding the work-pieces into coreless-rolls and the taper comprising a tape dispenser and printer for printing identifying data onto a piece of tape applied to fasten each coreless roll closed wherein the cutter and the printing of the tape is controlled by the control computer, wherein the cutter is configured to section the work-piece from the feedstock after it has started to be fed into the rewinder.

Typically the feed-stock is roll-stock.

Optionally the feed-stock is single sheets and the cutter is not required.

Preferably, the printing system further comprises lengthwise cutters for cutting the medium into narrower strips.

Optionally, the printing system comprising a plurality of rewinders mounted side by side in parallel across width of the printer.

In one configuration, the two or more rewinders mounted side by side along the printer, separately rewind work-pieces printed in parallel.

In another configuration, two or more rewinders mounted side by side along the printer, work in tandem to rewind a wide work-piece into a wide coreless roll.

In yet another configuration, two tapers are mounted side by side along a single rewinder for either applying two pieces of tape to a wide roll, or for taping and labeling two separate work-pieces that are printed in parallel along the printer and wound up into two separate rolls by the same rewinder.

Optionally the printing machine further comprises an inspection unit positioned downstream of the printing and upstream of the rolling station for confirming that the work-piece is correctly printed and sectioned.

Optionally, the inspection unit comprises a digital camera that is coupled to a computer for examining and assessing printer's marks. Optionally, the inspection unit comprises a digital camera that is coupled to a computer and a memory, the computer for comparing a digital image of the work-piece with a reference image in the memory.

In some embodiments the computer of the inspection unit is the control computer of the digital printer.

Typically the taper printer is selected from the group comprising a dot matrix printer a simple ink jet printer and a thermal tape printer.

Optionally, the work-piece is a tile of a larger image, and the identifying data identifies the tile.

In some embodiments the output is a multiple tile poster comprising several separate tiles, and each tile is individually rolled by the rewinder to form one multi-sheet coil.

In some embodiments, several separate work pieces are wound onto the same roll.

These may be identical work-pieces or separate tiles of the same larger image.

A second embodiment is directed to a method of fabricating printed work-pieces, comprising supplying a medium to a system comprising a printer, sectioner, rewinder and taper; printing a desired image onto the roll, feeding the printed image into a rewinding station, optionally sectioning the image from the roll, rewinding the printed work-piece into a coreless roll, printing identifying data onto the tape and taping and labeling the coreless roll closed with a piece of tape dispensed from the taper, wherein a common control computer controls the printing, sectioning and application of identifying data onto the tape.

Preferably an inspection system comprising a digital camera downstream of the printer and upstream of the rewinder, a memory for storing a reference image and comparison software for comparing the printed image with the reference image is provided, and the method comprises inspecting the work piece and printing results of inspection on the tape.

Optionally a second image is rewound over the first image.

DESCRIPTION OF THE FIGURES

For a better understanding of the invention and to show how it may be carried into effect, reference will now be made, purely by way of example, to the accompanying drawings.

With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention; the description taken with the drawings making apparent to those skilled in the art how the several forms of the invention may be embodied in practice. In the accompanying drawings.

BRIEF DESCRIPTION OF THE PREFERRED EMBODIMENTS

Figure 1:
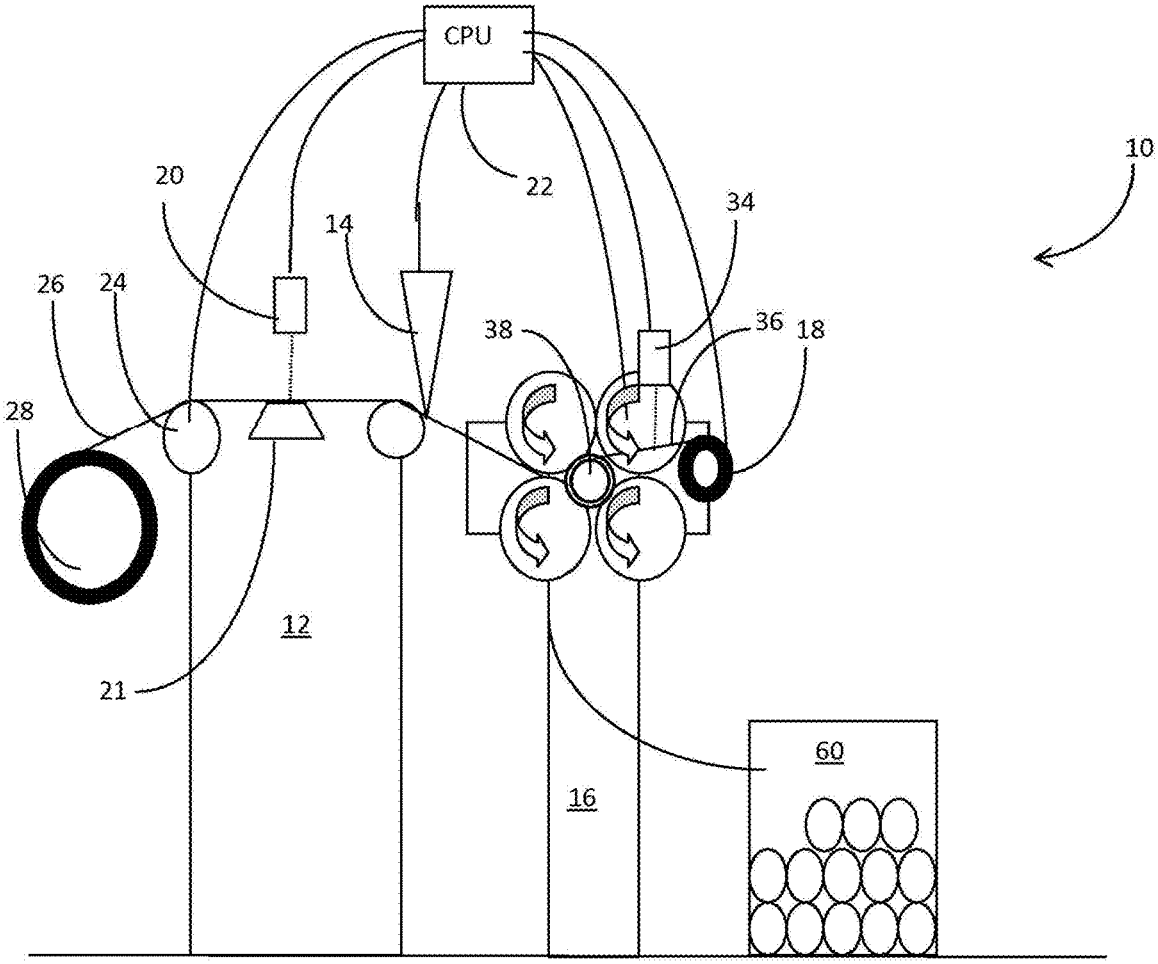
FIG. 1 is a schematic illustration of a system comprising a printer, cutter, rewinder and taper in accordance with a first embodiment of the invention.

FIG. 1 is a schematic illustration of a system 10 comprising a printer 12, cutter 14, rewinder 16 and taper 18 in accordance with a first embodiment of the invention;

With reference to FIG. 1, a printer 12 with a cutter 14 running along a track parallel to the print track of the carriage of the printing unit 20 is shown. The printer 12 is typically a wide format printer and may be an inkjet printer, and is controlled by a control computer 22 that controls the printing unit 20, the forwarding roller 24 for forwarding the medium 26 from the feed roll 28 past the printing unit 20 over the print table 21, and the cutter 14 that sections the medium 26 after printing thereon to singulate the work-piece, such as a poster for example. The printing unit 20 may be a carriage containing a number of inkjet print cartridges coupled to print heads. The inkjet cartridges will typically include various colored inks, such as Yellow, Cyan and Magenta, and perhaps black, white, a spot color, silver, gold, light colors and so on. The cutter may be a guillotine blade or a rotary cutter, for example.

By way of non-limiting enablement only, the wide format printer may be a dual mode printer capable of printing onto roll stock or onto separate sheets in flat-bed mode. Such a printer is described in U.S. Pat. No. 7,901,150 titled "Dual Mode Printer" to Liberman and Shapira and assigned to Matan Digital Printers ltd.

The cutter may be an embodiment as described in US2014210896 (A1) to Yaron Tal titled "Method and System for Sectioning Artwork from Medium" and assigned to Matan Digital Printers ltd.

Coupled to the wide format printer 12, downstream thereof, a rewinder 16 is provided that is in data communication with the control computer 22. Rewinders are known. They typically comprise an array of typically four interleaving rollers that revolve in the same direction while maintain a steady force on a coreless roll of media. The feed roll 28 pushes the printed media into the rewinder, and only then, after rewinding is initiated, is the printed image sectioned from the roll of unprinted media by a sectioning blade 14 that sections the printed media from the feed roll 28. A taper 18 is mounted on the rewinding unit 30, and this is provided with a simple printer 34, such as a thermal or dot-matrix printer, that prints data onto the tape 36 prior to it being applied to the rolled up work-piece 38. The printer 34 of the taper 18 is also in data communication with the control computer 22 of the wide format inkjet printer 12.

The tacky side of the tape 36 is applied to the outside (typically half way along its length) of the rolled up work-piece, as the tape is pulled off the dispenser, it is printed, and then cut off to separate the printed tape from the roll. Such tapers are used to seal rolls and to apply labels. Identifying information for identifying the work-piece 38 is printed by the simple printer 34 onto the tape 36, and so the combination printer 12 and rewinder 16 prints, sections and rolls up work-pieces and then the taper 18 tapes the rolled up work-piece 38 with a tape 36 that has been printed with identifying information.

In this manner, rolled up work-pieces 38, such as posters or lengths of wallpaper and the like, are printed, rolled and labeled for subsequent identification and tracking. The drums of the rewinder 16 separate to allow the rolled up and taped work-piece 38 to fall out and be collected into a box 60, etc.

Figure 2:
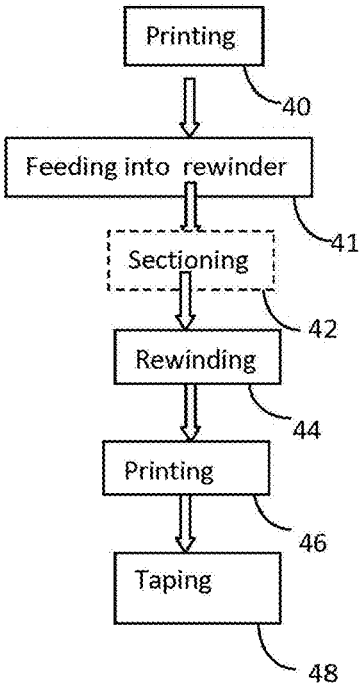
FIG. 2 is a flowchart of a first method for producing labeled, coreless rolled printed media in accordance to one embodiment of the invention.

As shown, the feedstock is roll stock 28, but it will be appreciated that at least theoretically, the media 26 could be provided to the printer 12 in large flat sheets, printed, fed into the rewinder 16 and then sectioned from the flat sheet if necessary, after the rewinder starts to rewind the printed work-piece. Indeed, if printing full sheet images in flat-bed mode onto sheets, the cutting stage is typically unnecessary and the cutter would not be used, but rather the sheets would be printed and rolled. Thus with further reference to FIG. 2, a wide format printer 12 may be used to print different posters to order, and using the system 10 described, each poster or other work-piece maybe printed—step (40), started to be fed into a rewinder—step 41, optionally sectioned—step (42) from the continuous feedstock 26 (typically unspooled from a roll 28) or not sectioned, when a full roll of feedstock is used, or when printing onto media provided as discrete sheets, rewound—step (44) to form a coreless roll, printing identifying information onto a tape—step (46) and taping the roll closed—step (48), thereby also labeling it and making it possible to identify without unrolling.

Although rewinders 16 that rewind and then tape up work-pieces 38 are known, to the best of our knowledge, rewinders (rewinding machines) 16 that also tape up and label work-pieces with data directly input from the control computer 22 of the printer 12 are not known. The combined system 1 enables full automation and tracking, and avoids mislabeling of work-pieces.

The printer 12 is typically a wide format printer and may be a very wide format printer that can print media as wide as 10 m. To maximize the efficiency and versatility of printer 12, it is possible to print several work-pieces simultaneously onto the same media fed into the printer, or onto parallel media fed onto different parts of the printer table along the printer. Lengthwise cutters may be mounted to section the print media in a direction perpendicular to that scanned over by the printer carriage, to section a wide piece of medium into narrower strips.

In yet another configuration, two tapers 18 are mounted side by side along a single rewinder 16 for either applying two pieces of tape 36 to a wide rolled up work-piece, or for taping 48 and labeling 46 two separate work-pieces 38 that are printed in parallel along the printer 36 and wound up into two separate rolls by the same rewinder 16.

Figure 3:
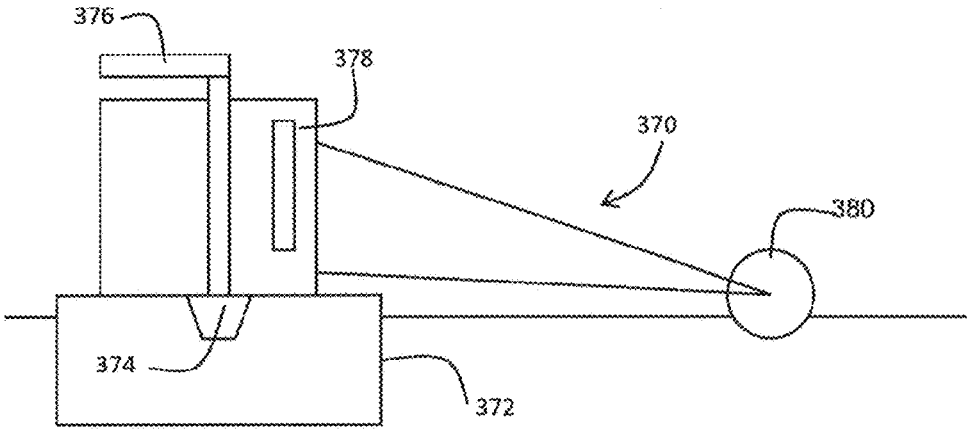
FIG. 3 is a schematic illustration of a lengthwise cutter.

With reference to FIG. 3, a schematic illustration showing how a lengthwise cutter arm 370 may be manually locked to a bar 372 that is part of the chassis supporting a printer 100, using a lock nut 374 having a fixed handle 176 for manual locking. An actuator 378 is provided for lowering and raising the cutter 380. Actuator 378 may be controlled by the control computer 22 (see FIG. 1).

Figure 4:
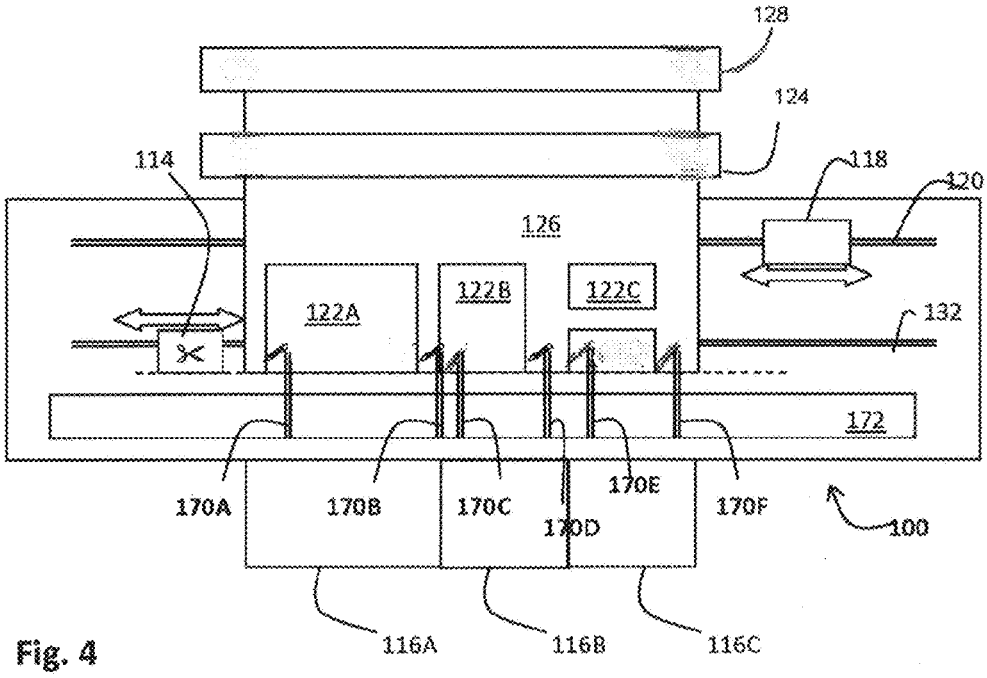
FIG. 4 is a schematic plan view of a wide format inkjet printing system with integral widthwise cutter and lengthwise cutter(s) and a plurality of rewinders mounted in parallel across the width of the printer.

With reference to FIG. 4 a schematic illustration of the printing system 10 of FIG. 1 is shown with a number of lengthwise cutters 170A, 170B, 170C, 170D, 170E, 170F configured to cut the medium 12 perpendicularly to the track 132 followed by the widthwise cutter 114. Preferably at least one and typically as many as six or eight lengthwise cutters 170 are provided. Furthermore, a plurality of rewinders 116A, 116B and 1160 are shown, coupled to the printer in parallel with each other, across the printer.

The lengthwise cutters 170 are attachable to the same chassis of the printer as that carrying the widthwise cutter and printhead, and are typically coupled to a bar 172 that is parallel to the track 132 followed by the widthwise cutter 114. The lengthwise cutters 114 are generally configured to section the medium 126 at settable positions across the width of the medium 126, to make cuts that are perpendicular to the cuts made by the widthwise cutter 130.

Each lengthwise cutter 170 may be a fixed or a rotary blade configured to cut as a knife. In this manner, it may be configured to start a cut in taut media 112 away from an edge. In some embodiments, however, a lengthwise cutter 170 comprises a pair of blades configured as a scissors arrangement and in other embodiments a lengthwise cutter 170 may be configured as a guillotine blade.

The lengthwise cutters 170 may be manually positionable or automatically positionable in different positions across the width of the printing machine 100 by an automated positioning arrangement controlled by the computer controller 22 and may be positioned with respect to the widthwise cuts made by the widthwise cutter 114, but will generally be positioned with respect to the edges of the images 122 printed. In some embodiments, such as where an irregular shaped image is printed or where test is printed on a page and margins are required, the lengthwise cutters 170 are set to follow registration marks.

In some embodiments, the processor 22 may control the depression of lengthwise cutters 170 by a computer controlled depressing mechanism. This may include servomotors or electromagnets for raising or lowering the lengthwise cutters 170, and in some embodiments, a counter-force, such as a spring for returning the lengthwise cutter 170 to its home position (which may be at an angle for cutting or not for cutting.

The plurality of rewinders 116A, 116B and 1160 are coupled to the printer in parallel with each other, across the printer and are attachable to the same chassis of the printer as that carrying the widthwise cutter and printhead, and are typically coupled in parallel to the track 132 followed by the widthwise cutter 114. Instead of a single rewinder 16 that extends the width of the printer, a plurality of narrower rewinders 16A, 16B, 16C positioned in parallel with each other, and coupled to the printer 12 may be provided. Each rewinder 16A (16B, 16C) may be set up to rewind work-pieces that are substantially narrower than the print-table and which are printed in parallel. Alternatively, two or more narrow rewinders 16A+16B may be configured to work together, effectively providing a wider rewinder for rewinding wide work-pieces.

Thus, for example, a 5 meter wide printer could be provided with a 1.6 m wide rewinder and a 3.2 m wide rewinder, enabling rewinding of 1.6 m media, 3.2 m media, and by working together, also 4.8 or 5 m wide media.

Alternatively, three 1.6 m rewinder units could cover the same options, but additionally allow three 1.5 or 1.6 meter wide work-pieces to be printed side by side and separately rewound onto three coreless rolls.

Figure 5:
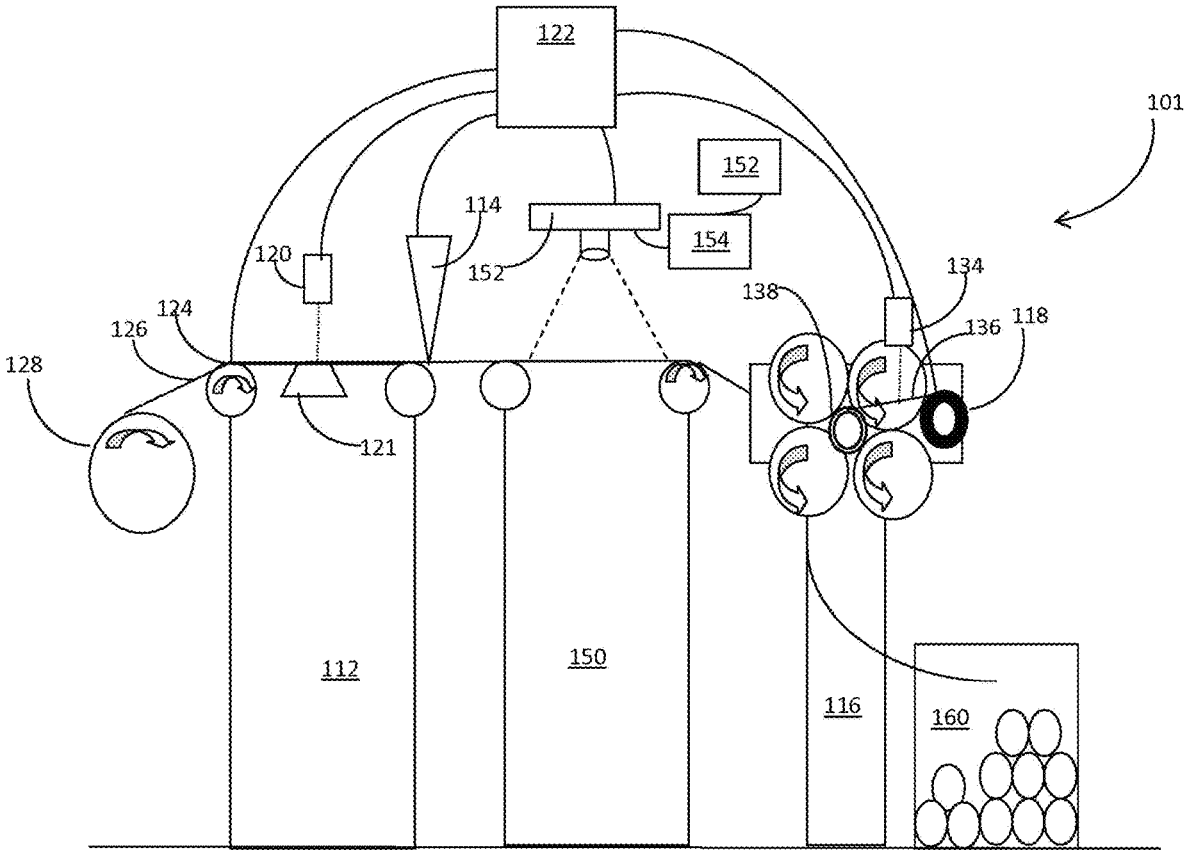
FIG. 5 is a schematic illustration of a system comprising a printer, cutter, inspection unit, rewinder and taper in accordance with a second embodiment of the invention.

With reference to FIG. 5, a schematic illustration of a system 101 comprising a printer 112, cutter 114, inspection unit 150, rewinder 116 and taper 118 in accordance with a second embodiment of the invention. With reference to FIG. 3, a printer 112, such as a wide format inkjet printer with a cutter 114 running along a track parallel to the print track of the carriage of the printing unit 120 is shown. The printer 112 is controlled by a control computer 122 that controls the printing unit 120 the forwarding roller 124 for forwarding the medium 126 from the feedstock 128, typically roll-stock 128 past the printing unit 120 over the print table 121, and the cutter 114 that sections the medium 126 after printing thereon to singulate the work-piece, such as a poster for example. Coupled to the wide format printer 112, downstream thereof, an inspection station 150, typically consisting of a camera 152, memory 154 and processor 152 is provided, that can compare the printed image of the work-piece with a reference image in the memory 154 using appropriate software running on the processor 152, which may or may not be the CPU 122 of the printer, but is in data-communication therewith. A rewinder 116 is also provided that is in data communication with the control computer 122. A taper 118 is mounted on the rewinding unit 116, and this is provided with a simple printer 134, such as a thermal or dot-matrix printer, that prints data onto the tape 136 prior to it being applied to the rolled up work-piece 138. The printer 134 of the taper 118 is also in data communication with the control computer 122 of the wide format inkjet printer 112.

Typically the inspection system 150 is used to check the existence and placement of printer's marks in the margins of work-pieces. Such printer's marks are used to check that the various ink-heads are correctly aligned and are printing properly and that none of the inks have run out. By way of non-limited example only, printer's marks may include color bars and centering marks, or a 'traffic light', and superimposed crosses of color. The camera 152 images these printer's marks, and the processor 152 assesses them to determine that each ink is applied correctly.

The tape dispenser 118 is configured so that the rotation of the rolled up work-piece 138 against the end of the tape 136 pulls the end off its spool and onto the rolled up work-piece 138. Data received from the control computer 122 is printed by a dedicated, simple printer 134 onto the tape 136, to identify the work-piece, and to provide details of the quality of the printing 40 (and sectioning 42) as determined by the inspection station 150.

A serrated edge on the tape dispenser (taper) 118 cuts the tape as the rolled up work-piece 138 is rotated. The rollers of the rewinder 116 then separate, and the coreless rolled up and taped work-piece 138 is drops into a container 160, with other work-pieces, Identifying information for identifying the work-piece 138 is printed by the simple printer 134 onto the tape 136, and so the combination printer 112 and rewinder 116 prints, sections and rolls up work-pieces and then the taper 118 tapes the rolled up work-piece 138 with a tape 136 that has been printed with identifying information. In this manner, rolled up work-pieces 138, such as posters or lengths of wallpaper and the like, are printed, rolled and labeled for subsequent identification and tracking.

Thus, in addition to the components of the system 1 of FIG. 1, in the system of FIG. 3, a visual inspection system 150 is provided. The visual inspection system 150 typically comprises a digital camera 152 coupled to a memory 154 and processor 156, for comparing images captured with the camera 152 to reference images in the memory 154. The inspection system is also controlled by the computer controller 22 of the printer 112 unit, and in some embodiments, the images compared by the camera 152 are compared to the reference images by the control computer 122. Data resulting from the comparison is printed onto the tape 136 using the printer 134 of the taper 118. This data may include a rejection code indicating mis-printing, mis-sectioning and the like, or a quality assurance code, indicating that the printing and sectioning is acceptable.

Figure 6:
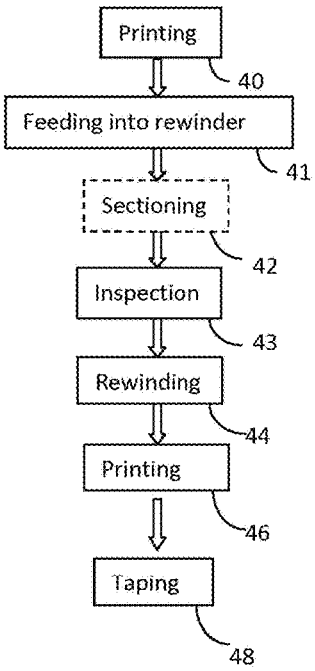
FIG. 6 is a flowchart of a first method for producing labeled, coreless rolled printed media in accordance to a further embodiment of the invention.

With further reference to FIG. 6, a wide format printer 112 may be used to print different posters to order, and using the system 101 described, each poster or other work-piece may be printed—step (40), fed into a rewinder 116—step (41), optionally sectioned—step (42) from the continuous media 126 unspooled from the roll stock 128 or not sectioned if the entire roll is printed or if individual sheets are provided in flat-bed mode, inspected—step (43) in a quality control stage 150 for checking the printed image prior to rewinding 44. As schematically shown, the inspection step 43 is performed at an inspection table 150 downstream of the cutter 114, however advantageously it is performed prior to cutting, and may be performed close to the printing, so that if a defect is detected, the printing may be stopped and the media saved. Inspection is performed by a camera 152 opposite the media, and the best place may be on the print table 121. The results of the quality control inspection 43 may be printed—step (46) together with other information, identifying the work-piece, such as a description thereof, name (or a code) for the customer, and the like. Such a quality control stage 116 may be upstage or downstream of the sectioning 42, but is preferably downstream thereof, so that the quality of the sectioning is also inspected, and typically includes a camera 152 that takes a digital image of the printed output and compares it with a reference image stored in a memory 154 by appropriate image analysis software running on a computer 156, possibly the control computer 122, or otherwise checks for defects. If such quality control stage is incorporated into the system 101, rejected work-pieces may be labeled 'rejected', 'scrap' or the like by the taper printer 134, or a more detailed description of the problem may be printed onto the tape 136. Without appropriate inspection after printing, it is possible that one will end up with many rolled up work-pieces but all with defects. After taping, the rewinder typically releases the coreless rolled up work-piece 138 into a container 160.

Where the individual rolls contain part (a 'tile' of a larger image, such as a very larger poster), having the tape on a roll unambiguously labeled with a description of its content prevents the roll being unnecessarily unwound and dirtied. Whilst this can be done manually or by entering data at a separate machine from that printing the work-piece, the integration enables automation and minimizes the likelihood of mistakes. It will be noted that the system of the invention may be used to print work-pieces of highly varying lengths, from a minimal length to a roll of wallpaper of a sign that covers several stories of a multi-story building.

It will be appreciated that the rewinder 16 (116) can wind coreless rolls, but could also wind onto a core. For tiles of a large image, this usefully enables different tiles to be wound one on top of another, so a single roll includes several, and preferably all the tiles of the multiple-tile image, and these can be unrolled, pasted and mounted one by one.

This feature can also be used to roll several identical posters onto the same roll, which saves space and makes shipping and tracking easier.

Thus persons skilled in the art will appreciate that the present invention is not limited to what has been particularly shown and described hereinabove. Rather the scope of the present invention is defined by the appended claims and includes both combinations and sub combinations of the various features described hereinabove as well as variations and modifications thereof, which would occur to persons skilled in the art upon reading the foregoing description.

In the claims, the word "comprise", and variations thereof such as "comprises", "comprising" and the like indicate that the components listed are included, but not generally to the exclusion of other components.

The invention claimed is:

1. A printing system for printing images onto a medium supplied as feed-stock, said system comprising a printer, a control computer and data inputting means, a printer head, a cutter, at least one rewinder and a taper;

the print head for printing individual work-pieces onto the medium, the cutter for cutting the medium into individual work-pieces, and the at least one rewinder for rewinding the work-pieces into coreless-rolls and the taper comprising a tape dispenser and printer for printing identifying data onto a piece of tape applied to fasten each coreless roll closed wherein the cutter and the printing of the tape is controlled by the control computer, wherein the cutter is configured to section the work-piece from the feed-stock after it has started to be fed into the rewinder.

2. The printing system of claim 1, wherein the feed-stock is roll-stock.

3. The printing system of claim 2 wherein the inspection unit comprises a digital camera that is coupled to a computer and a memory, the computer for comparing a digital image of the work-piece with a reference image in the memory.

4. The printing system of claim 2 wherein the inspection unit comprises a digital camera that is coupled to a computer for examining and assessing printer's marks.

5. The printing system of claim 4 wherein several identical work-pieces are rolled onto the same roll by the rewinder.

6. The printing system of claim 1 further comprising lengthwise cutters for cutting the medium into narrower strips.

7. The printing system of claim 1, comprising two tapers 18 are mounted side by side along a single rewinder for either applying two pieces of tape to a wide rolled up work-piece, or for taping and labeling two separate work-pieces that are printed in parallel along the printer and wound up into two separate rolls by the same rewinder.

8. The printing system of claim 1 comprising a plurality of rewinders mounted side by side in parallel across width of the printer.

9. The printing system of claim 8, wherein two or more rewinders mounted side by side along the printer, separately rewind work-pieces printed in parallel.

10. The printing system of claim 8, wherein two or more rewinders mounted side by side along the printer, work in tandem to rewind a wide work-piece into a wide coreless roll.

11. The printing system of claim 1 wherein the feed-stock is single sheets supplied for flat bed printing and the cutter is not required.

12. The printing system of claim 1 wherein the output is a multiple tile poster comprising several separate tiles, and each tile is individually rolled by the rewinder to form one multi-sheet coil.

13. The printing system of claim 1 further comprising an inspection unit positioned downstream of the printing and upstream of the rolling station for confirming that the work-piece is correctly printed and sectioned.

14. The printing system of claim 13, wherein the computer is the control computer.

15. The printing system of claim 1 wherein the taper printer is a dot matrix printer, a simple ink jet printer, or a thermal tape printer.

16. The printing system of claim 15 where a work-piece is a tile of a larger image, and the identifying data identifies the tile.

17. The printing system of claim 15 wherein several tiles of the larger image are rolled onto the same roll by the rewinder.

* * * * *